US008813264B2

(12) United States Patent
Boos

(10) Patent No.: US 8,813,264 B2
(45) **Date of Patent: *Aug. 26, 2014**

(54) APPARATUS FOR KEEPING A SHIRT COLLAR ALIGNED AND FASTENED, MAGNETICALLY

(76) Inventor: Jonathan B. Boos, Sarasota, FL (US)

( * ) Notice: Subject to any disclaimer, the term of this patent is extended or adjusted under 35 U.S.C. 154(b) by 214 days.

This patent is subject to a terminal disclaimer.

(21) Appl. No.: 13/366,764

(22) Filed: Feb. 6, 2012

(65) Prior Publication Data

US 2012/0151661 A1 Jun. 21, 2012

Related U.S. Application Data

(60) Continuation-in-part of application No. 12/189,504, filed on Aug. 11, 2008, now Pat. No. 8,108,948, which is a division of application No. 11/393,126, filed on Mar. 30, 2006, now Pat. No. 7,409,730.

(60) Provisional application No. 60/594,367, filed on Mar. 31, 2005.

(51) Int. Cl.
*A41B 3/00* (2006.01)

(52) U.S. Cl.
USPC ..... 2/132

(58) Field of Classification Search
USPC ..... 2/131–139, 255–260, 260.1, 261, 262, 2/144–145, 156, 130, 155; 24/66.1, 658, 24/688, 303
See application file for complete search history.

(56) References Cited

U.S. PATENT DOCUMENTS

| | | | | |
|---|---|---|---|---|
| 2,397,931 | A | 4/1946 | Ellis | |
| 2,964,756 | A | 12/1960 | Liebowitz | |
| 3,086,268 | A | 4/1963 | Chaffin, Jr. | |
| 3,161,932 | A | 12/1964 | Russell | |
| 3,509,734 | A | 5/1970 | Lederer | |
| 3,686,692 | A | 8/1972 | Snare et al. | |
| 4,118,803 | A | 10/1978 | Blau | |
| 4,286,337 | A | 9/1981 | Malouf et al. | |
| 4,434,512 | A | 3/1984 | Hansen | |
| 4,653,119 | A | 3/1987 | Kaiser | |
| 4,922,553 | A | 5/1990 | Morrone | |
| 4,959,890 | A | 10/1990 | Pazurek | |
| 5,732,451 | A | 3/1998 | Mars | |
| 5,740,557 | A | 4/1998 | Reid | |
| 5,974,634 | A | 11/1999 | Eisenpresser | |
| 6,089,422 | A | 7/2000 | Gibson | |
| 6,167,732 | B1 | 1/2001 | Friedman | |
| 6,170,131 | B1 | 1/2001 | Shin | |
| 6,226,842 | B1 | 5/2001 | Wong | |
| 6,434,801 | B2 | 8/2002 | Grunberger | |
| 6,748,602 | B1 | 6/2004 | Barnes | |
| 7,409,730 | B2 * | 8/2008 | Boos | 2/132 |
| 8,108,948 | B2 * | 2/2012 | Boos | 2/132 |

* cited by examiner

*Primary Examiner* — Tejash Patel
(74) *Attorney, Agent, or Firm* — Matthews Edwards LLC

(57) ABSTRACT

Apparatus for magnetically holding a shirt collar in a position and orientation on a shirt front, includes a collar stay attachable to a collar via adhesive or the like, or receivable in a pocket of the collar. The collar stay includes a material attractable by a magnet and can include at least a peripheral edge portion of a polymer material to protect adjacent shirt fabric. A magnet is positionable against an inside surface of the shirt front opposite the collar and is magnetically attachable to the collar stay through the shirt front, for holding the collar in a desired position and orientation. Suitable polymers include plastics and rubbery materials, and can be elastic so as to be stretchable over the stay. The stay can also be a laminate or composite of the material attractable by the magnet and the polymer, and can be bendable or foldable into a desired shape.

45 Claims, 13 Drawing Sheets

APPARATUS FOR KEEPING A SHIRT COLLAR ALIGNED AND FASTENED, MAGNETICALLY

This application is a continuation-in-part of patent application Ser. No. 12/189,504, filed Aug. 11, 2008 now U.S. Pat. No. 8,108,948, which application is a division of U.S. patent application Ser. No. 11/393,126, filed Mar. 30, 2006, now U.S. Pat. No. 7,409,730, dated Aug. 12, 2008, and which application also claims the benefit of U.S. Provisional Application No. 60/594,367, filed Mar. 31, 2005.

TECHNICAL FIELD

This invention relates to apparatus for keeping a shirt collar properly aligned and fastened, magnetically, and more particularly, which also protects the fabric of a shirt with which the apparatus is used, from damage and wear that can result from contact with the apparatus.

BACKGROUND ART

The disclosures of co-pending patent application Ser. No. 12/189,504, filed Aug. 11, 2008, U.S. patent application Ser. No. 11/393,126, filed Mar. 30, 2006, now U.S. Pat. No. 7,409,730, dated Aug. 12, 2008, and U.S. Provisional Application No. 60/594,367, filed Mar. 31, 2005, are hereby incorporated herein in their entirety by reference.

The inability to keep a shirt collar properly aligned and fastened, has been an ongoing problem. Solutions to this problem involving magnetic devices, have been attempted. Reference in this regard, Barnes U.S. Pat. No. 6,748,602 entitled Decorative Magnetic Collar Stay, which utilizes a decorative, detachable/attachable outwardly visible magnetic top collar stay portion, and a concealed collar bottom stay portion. The top piece contains two magnets arranged to be attracted to magnets of the bottom piece, such that when the top piece is set on top of a collar with the bottom piece positioned directly underneath the collar, the top and bottom pieces are locked together via the magnetic attraction. The top piece provides a bridge for placement of a customized logo, which can be affixed thereto by a pin. A shortcoming, however, of the Barnes collar stay, is that it is always visible, which may not be desired. Another shortcoming is that multiple magnets are required for holding each collar, which makes the device hefty as well as weighty. Still further, no provision is disclosed for attachment of a collar to a shirt front. This can be a shortcoming where it is desired for the collar of a shirt to be positioned at a certain location on and in relation to the front of a shirt, and/or a certain orientation, for achieving a particular look.

Other devices utilizing magnetics are also known. Reference in this regard, Ellis U.S. Pat. No. 2,397,931, which discloses a magnetic button including two associated parts having the general appearance of an ordinary button, which are magnetic and oppositely attached to flaps of a garment to hold the flaps together. However, the parts are both simple disc shaped members, and there is no disclosure of a capability thereof for retaining the shape and/or alignment of a shirt collar.

As another consideration, some shirts are made of delicate materials, such as silks and the like, and any item used therewith should not cause damage or wear to such delicate shirt materials.

Thus, what is sought is apparatus adapted for keeping a shirt collar in a particular desired alignment with a shirt front or other reference, and fastened to the shirt front, and which overcomes one or more of the shortcomings and limitations discussed above.

SUMMARY OF THE INVENTION

What is disclosed is apparatus for keeping a shirt collar aligned and fastened, magnetically, which overcomes one or more of the shortcomings and limitations discussed above, particularly damage and wear that can result from use of the apparatus.

According to a preferred aspect of the invention, the apparatus includes a collar stay configured for attachment to an inside surface of a shirt collar or positionable within a collar stay pocket of a collar. The collar stay includes at least one surface bounded by a peripheral edge portion, and comprises a material attractable by a magnet. At least the peripheral edge portion of the collar stay is covered by a protective cover of a polymer or polymeric material, to prevent the edge portion from damaging or causing wear to adjacent fabric of a shirt with which it is used. A magnet positionable against an inside surface of a shirt front opposite a collar thereof and operable for magnetic attachment to the elongate collar stay through the shirt front, will hold a collar to which the collar stay is attached, against the shirt front.

According to another preferred aspect of the invention, the polymer or polymeric material provides protection for the material of the shirt against wear and other damage that can result from contact with an edge of the material attractable by the magnet. Suitable polymers or polymeric materials include, but are not limited to, plastics materials and rubber materials.

According to another preferred aspect of the invention, the magnet has a surface configured to be magnetically attached to the surface of the stay and having a predetermined extent, and the cover defines at least one aperture or window having a dimension sufficiently larger than the predetermined extent, so as to be capable of cooperatively receiving the magnet and at least one layer of the shirt between the magnet and the surface. As an example, the magnet can have a disk shape, and the aperture or apertures of the cover will have a shape and size marginally larger, to allow magnetic attachment of the magnet to the surface portion through the aperture with at least one layer of the shirt held therebetween. As an alternative, the cover can cover all or substantially all of the stay.

As another preferred aspect of the invention, the collar stay can comprise a 400 series stainless steel material, and the magnet can comprise a neodymium magnet.

As another preferred aspect of the invention, the stay can be a laminate comprising at least one inner layer comprising the material attractable by a magnet, and at least one outer layer comprising the cover. As an exemplary laminate construction, the inner layer or layers can comprise a ferrous foil or sheet, and the cover can comprise a composite of a fibrous material and a plastics resin, or just the resin.

As still another preferred aspect of the invention, the stay can comprise a composite of the material attractable by a magnet and the plastics or rubbery material. An exemplary composite can include particles or flakes of a ferrous metal such as, but not limited to, a carbon steel, electroplated iron, or 400 series stainless steel, dispersed in a polymer resin.

As still another preferred aspect of the invention, the stay can be bendable or foldable into a curved or angled shape, and retain the shape, to enable correspondingly shaping the collar in a desired manner.

According to another preferred aspect of the invention, the stay is of a thin, flat sheet or film material attractable by a magnet, such as a magnetic stainless steel material, having edge portions covered by the cover. The collar stay can have an elongate conventional overall collar stay shape, including a tapered longitudinal end portion adapted for insertion into a conventional collar stay pocket on the inside surface of a shirt collar, and a rounded opposite end portion. The collar stay can be, for instance, from about 2 to about 3 inches in length, or from about 4 to about 8 centimeters (cm). A suitable range for width is from about 0.6 to about 1.0 cm.

Alternative shapes of the stay according to the invention, particularly for adhesive attachment to a collar, such as, but not limited to, a polo shirt style collar, can include, but are not limited to, a decorative shield shape, a disk shape or any other shape that provides a desired shaping effect on the collar, decorative appearance, or level of concealment. With particular regard to polo style collars, a broader or wider shape than that of conventional collar stays may be desired, as adhesive attachment of the collar stay to the collar may be used to impart a desired shape to the collar, such as a flat shape. In this regard, the stays may be bendable into a desired retained shape, to enable imparting a matching shape to the collar, if desired.

As to thickness of the stays, a suitable value would be from about 0.3 to about 1 millimeter (mm). The collar stay can be substantially rigid and flat, or bendable using light finger pressure, to a desired shape. The magnet is preferably of a sufficiently small size so as to be concealable under the collar, yet still provide adequate magnetic force, and interlock with the stay, if desired. In this latter regard, a variety of shaped magnets can be used, such as, but not limited to, a dog bone or bow tie shape.

According to another preferred aspect of the invention, the collar stay can be attached to the inner or outer surface of a collar using any convenient manner of attachment, including, but not limited to, by use of an adhesive. For instance, an adhesive strip can be attached to the surface of the stay, and removed and replaced, as necessary when the adhesive is no longer functional. A spray on, dab on, or other adhesive can also be used. Still further, as another preferred aspect of the invention, the collar stay can be sewn in place between the inner and outer layers of the collar. In this latter regard, this is preferably done in a manner such that the stay is not visible from the outer side of the collar. Also, it is contemplated that the cover of the collar stay can include the apertures at several locations along the length thereof, such that the portion of the stay to which the magnet is to be attached is selectable from several portions to allow the stay to be located and oriented in some desired number of positions.

According to still another preferred aspect of the invention, the following steps are used with shirts featuring a collar stay pocket:

1. Slide the collar stay into the collar stay pocket of a collar;
2. Position the magnetic disk inside of the front of the shirt; and attach or connect the collar stay and the magnetic disk using the magnetic attraction properties of the disk; and
3. Repeat steps 1 and 2 on the other collar.

According to still another preferred aspect of the invention, the following steps are used with shirts without a collar stay pocket:

1. Peel the film off of the adhesive side of the collar stay, or apply the adhesive to a desired surface of the stay. Position the collar stay in the desired position and orientation on the inside or outside surface of the collar, and press firmly;
2. Position the magnetic disk inside of the front of the shirt; and attach or connect the collar stay and the magnetic disk using the magnetic attraction properties of the disk; and
3. Repeat steps 1 and 2 on the other collar.

DETAILED DESCRIPTION OF THE INVENTION

Figure 1:
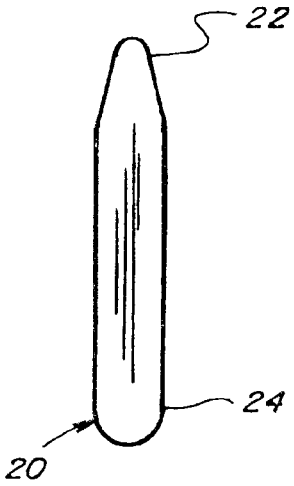
FIG. 1 is a side view of a collar stay of the invention.

Referring now to the drawings, wherein like numerals refer to like parts, FIGS. 1, 2, 3, 4, and 5 illustrate various elements of apparatus of the invention, required for practice of methods of the invention. More particularly, FIG. 1 illustrates a collar stay 20 of the invention, which is preferably of sheet metal construction composed of a magnetic stainless steel material, such as, but not limited to, a 400 series stainless steel, such as a 404 or 416 series. Stay 20 has an elongated shape including a tapered end portion 22 and an opposite end portion 24. Stay 20 is preferably from about 2 to about 4 inches in length, or of the other dimensions set forth above, so as to be insertable into a conventionally dimensioned and constructed collar stay pocket on the inner surface of a shirt collar, such as illustrated by pocket region A in FIG. 4, but can alternatively be of another suitable length and/or shape as desired or required for a particular application.

Figure 2:
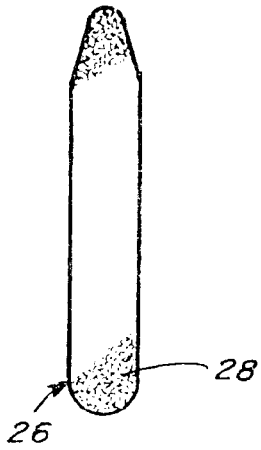
FIG. 2 is a side view of another collar stay of the invention.

FIG. 2 illustrates another collar stay 26 of the invention, constructed of the same material as collar stay 20, and of about the same dimensions, but having one surface including a layer of adhesive 28 thereon, which can be an adhesive film, coating, or layer, or an adhesive tape, having a side which faces outwardly from stay 26, for adhesion to an inner surface of a shirt collar, as will be explained. Collar stay 26 is contemplated for use with a shirt collar which lacks a collar stay pocket, or for use where a collar stay pocket is present but not desired to be used.

Figure 3:
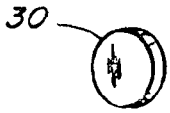
FIG. 3 is a perspective view of a magnet of the invention.

FIG. 3 illustrates a magnet 30 of the invention, which can be constructed of a suitable commercially available magnetic material, such as, but not limited to, a neodymium magnetic material, suitable for magnetically attaching to and holding a collar stay such as stay 20 or stay 26 through one or several layers of a typical shirt fabric, such as a cotton, wool, synthetic material, or blend of any of these, in a desired position and orientation.

Figure 4:
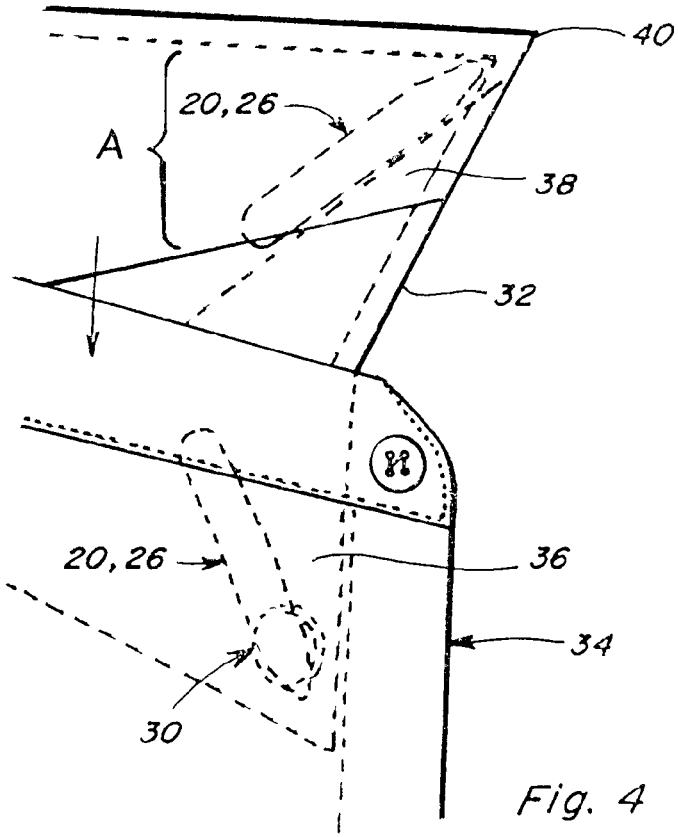
FIG. 4 is a front view of a shirt, showing a collar stay of the invention in connection with a collar of the shirt, and in dotted lines, the collar folded down and held in desired position and alignment by a magnet of the invention.
Figure 5:
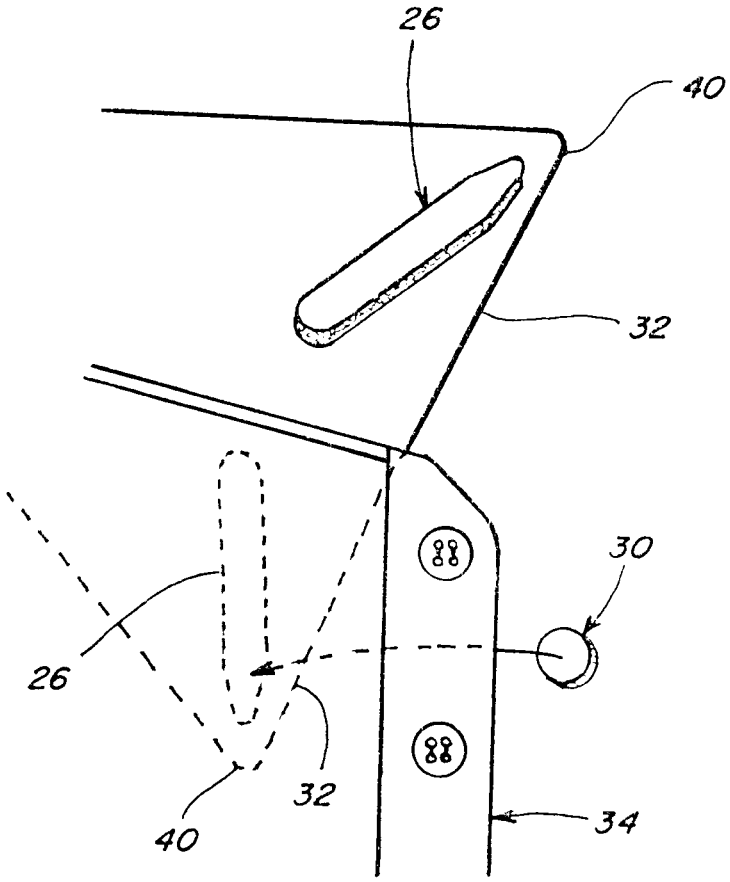
FIG. 5 is a front view of a shirt, showing a collar stay of the invention adhesively attached to an inner surface of a shirt collar, and in dotted lines, the collar folded down, and illustrating insertion of a magnet into the shirt behind the front surface thereof for magnetically holding the collar stay and the collar in a desired position and alignment in relation to the shirt front.

FIGS. 4 and 5 illustrate aspects of steps of methods of the invention for using a collar stay 20 or 26 and a magnet 30 with a collar 32 of a shirt 34, for holding the collar 32 in a desired position and orientation in relation to a front 36 of shirt 34. Essentially, collar stay 20 is slid into a collar stay pocket, such as pocket A (FIG. 4), on an inner or inside surface 38 of collar 32, or, collar stay 26 is adhered to the inside surface 38 (FIG. 5), in a desired position and orientation, such as, but not limited to, pointing toward a point 40 of collar 32 at a desired angular orientation in relation thereto, as illustrated. Magnet 30 is then positioned beneath or inside of front 36 of shirt 34 at a desired position for connection to stay 20 or 26 by magnetic attraction, as illustrated in dotted lines. These steps are then repeated for the other collar of the shirt. Here, it should be noted that neither collar stay 20 or collar stay 26 will typically be visible from the outer surface of collar 32, and magnet 30 will be concealed behind front 36 of the shirt, such that neither elements of the invention are evident. Yet, the magnetic attraction between magnet 30 and stay 20 or 26 will be sufficient to hold the collar, particularly point 40 thereof, in the desired position and orientation in relation to the shirt front.

Figure 6:
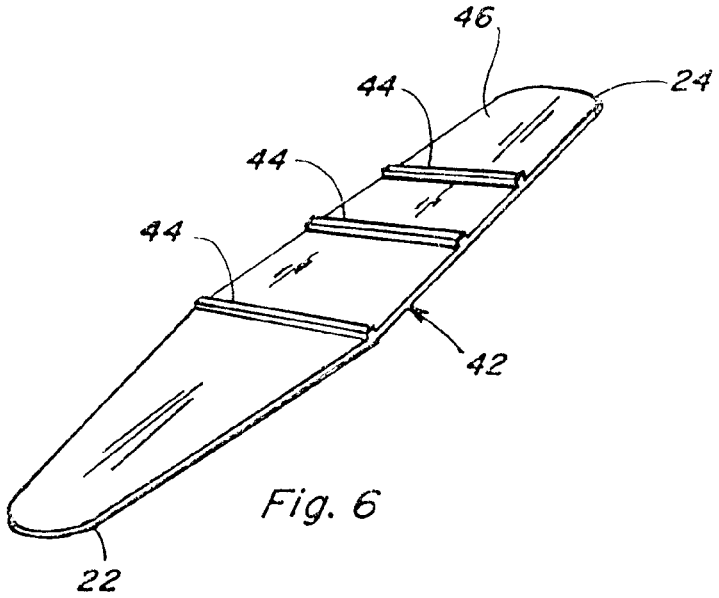
FIG. 6 is a perspective view of another collar stay of the invention.
Figure 7:
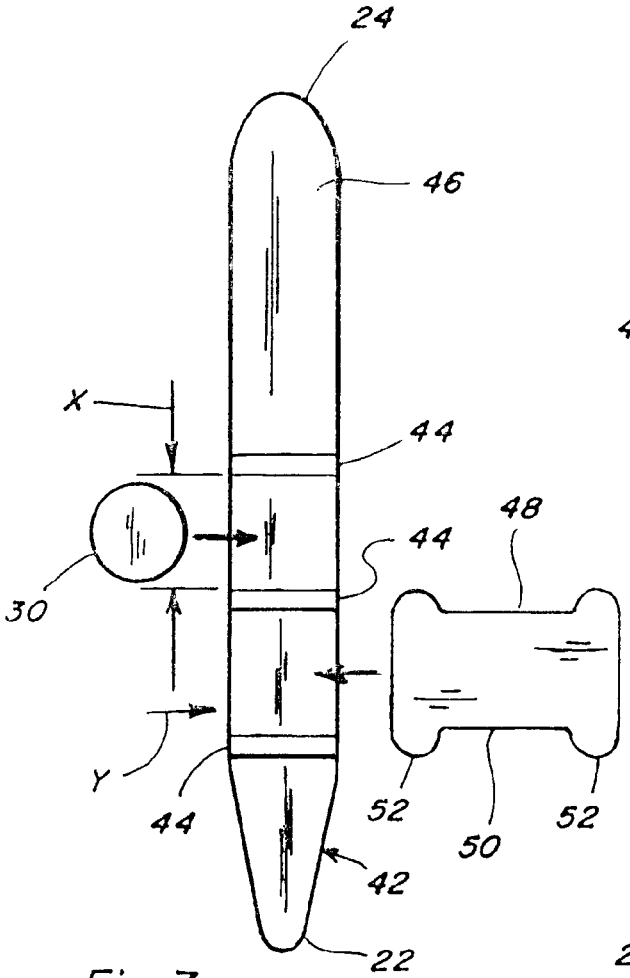
FIG. 7 is a side view of the collar stay of FIG. 6, illustrating alternative magnet constructions usable therewith in accordance with the invention.
Figure 8:
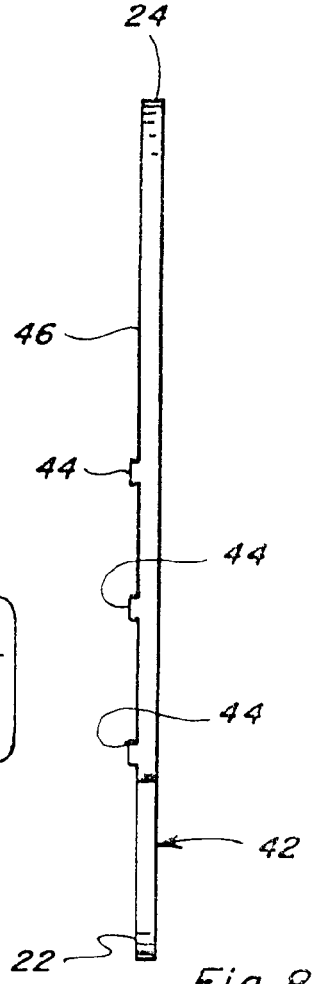
FIG. 8 is an edge view of the collar stay of FIG. 6.

FIGS. 6, 7 and 8 illustrate another collar stay 42 of the invention, like parts of stay 42 and stays 20 and 26 being identified by like numerals. Stay 42 is likewise preferably constructed of a magnetic stainless steel material such as a 400 series stainless steel and has an elongated shape including a tapered end portion 22 and a rounded end portion 24. An additional feature of stay 42, however, is at least one, and more preferably several, detents 44 protruding from an inside surface 46 of stay 42, at predetermined locations spaced from tapered end portion 22. Each detent 42 can have a shape or configuration suitable for preventing or substantially limiting movement of a magnet in close proximity and magnetically attached to surface 46, such as magnet 30, longitudinally along the surface 46, even when 1, 2 or 3 layers of shirt fabric are disposed therebetween. The detent 42 closest to end portion 22 is preferably disposed a distance X from end portion 22, and adjacent ones of detents 42 are preferably about the distance X apart, distance X preferably being equal to an amount just marginally larger than the cross-sectional extent of a magnet, such as magnet 30, to be used therewith, such that the magnet can be disposed between two of the detents 42 and held longitudinally in place. Here, although three detents 42 are illustrated, it should be understood that a greater, or a lesser, number of detents could be used. In FIG. 7, it should also be noted that an alternative magnet 48 is shown having a generally "bow tie" or "dog bone" shape having a narrowed intermediate portion 50 disposed between opposite and portions 52, intermediate portion 50 as measured between opposite and portions 52 having an extent preferably just marginally larger than a sideward extent Y of stay 42, such that when magnetically attached, both sideward and longitudinal relative movement of magnet 48 and stay 42, and thus a collar such as collar 34, will be prevented or substantially limited.

Figures 9, 10, 11, 12, 13:
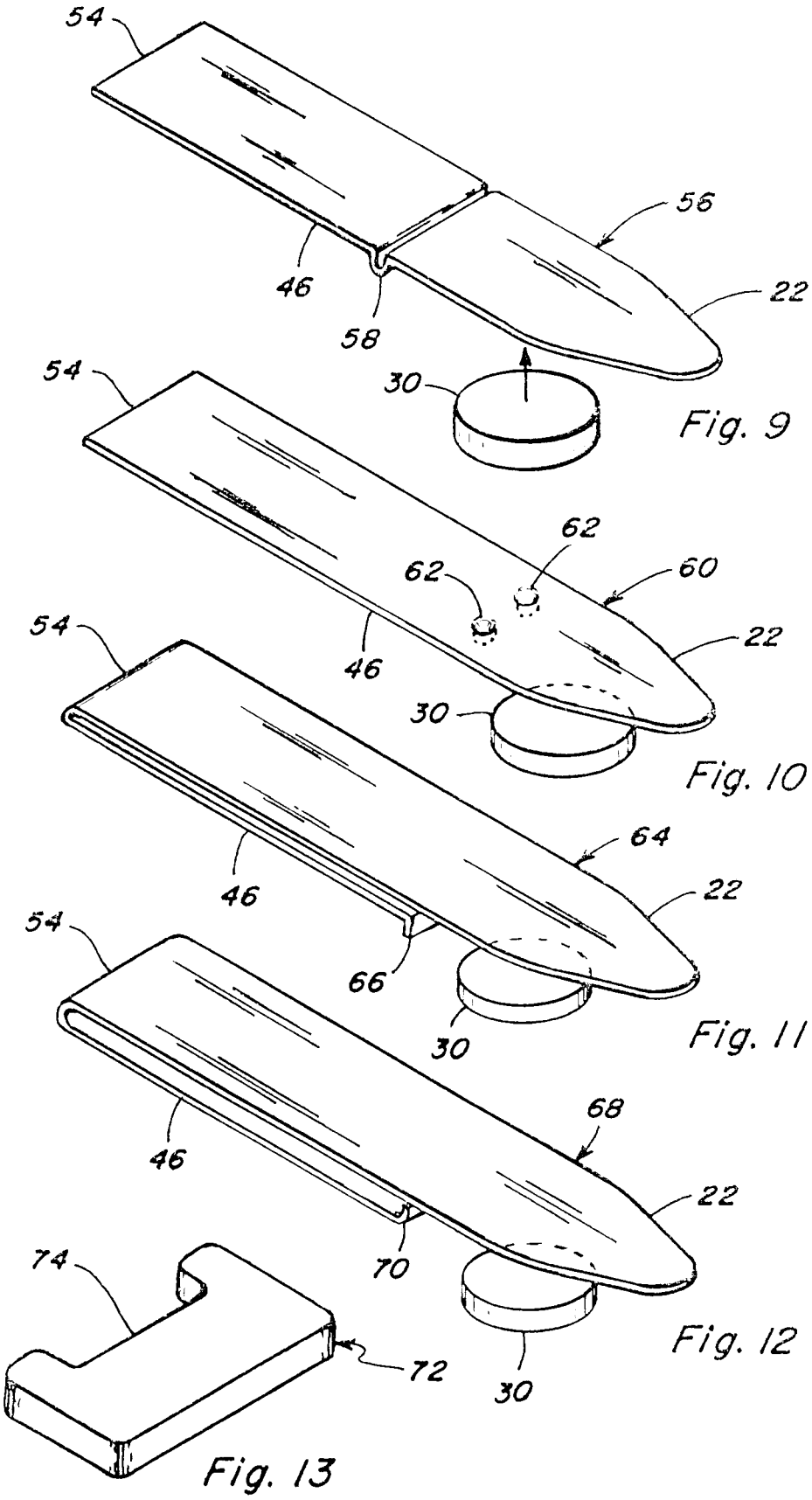
FIG. 9 is a perspective view of another collar stay of the invention, and a magnet.
FIG. 10 is a perspective view of another collar stay of the invention, and a magnet.
FIG. 11 is a perspective view of still another collar stay of the invention, and a magnet.
FIG. 12 is a perspective view of yet another collar stay of the invention, and a magnet.
FIG. 13 is a perspective view of an alternative magnet construction of the invention.

FIGS. 9, 10, 11 and 12 illustrate still further alternative embodiments of collar stays of the invention, like parts of the collar stays of these FIGS. and those of the earlier FIGS. being identified by like numerals. Each of the collar stays of FIGS. 9, 10, 11 and 12 can be constructed of the above described magnetic stainless steel material, and can have a similar overall size and shape as discussed above, generally including a tapered end portion 22 and an opposite rounded end portion 24 (see above), or a more squared and portion 54, as desired. In FIG. 9, a collar stay 56 is shown, including a detent 58 on an inside surface 46 thereof, which will face a shirt front, for preventing or limiting longitudinal movement of a magnet magnetically attached thereto, as illustrated generally by magnet 30. Detent 58 can be formed in any suitable manner, such as by folding or creasing stay 56. Here, it should again be noted that one or more of detents 58 could be used, as desired or required for a particular application. In FIG. 10, a collar stay 60 includes a pair of detents 62 protruding from surface 46, similarly positioned for the same purpose for preventing longitudinal movement of a magnet therealong. Here, detents 62 are spaced sidewardly apart sufficiently to also serve to center a magnet, such as magnet 30, in relation to the side edges of collar stay 60. Again, one or more pair of detents 62 can be used at desired longitudinal positions on surface 46, as desired or required for a particular application. Detents 62 can comprise raised portions or protrusions from surface 46, formed using a suitable metalworking technique, such as peening, stamping, or the like. Detents 62 could also be formed by welding, or adhesion of separate members onto surface 46. In FIG. 11, another collar stay 64 it is illustrated which is of a folded sheet metal construction so as to include a raised detent 66 protruding from surface 46. This construction can also be made by a suitable metalworking technique. Detent 66 will function in the above described manner for preventing longitudinal movement of a magnet, such as magnet 30, along the collar stay 64. And, in FIG. 12, collar stay 68 is also of a folded sheet metal construction to include a detent 70 on an edge of inside surface 46 adjacent to a magnet, such as magnet 30, for preventing longitudinal movement of the magnet.

Figure 28:
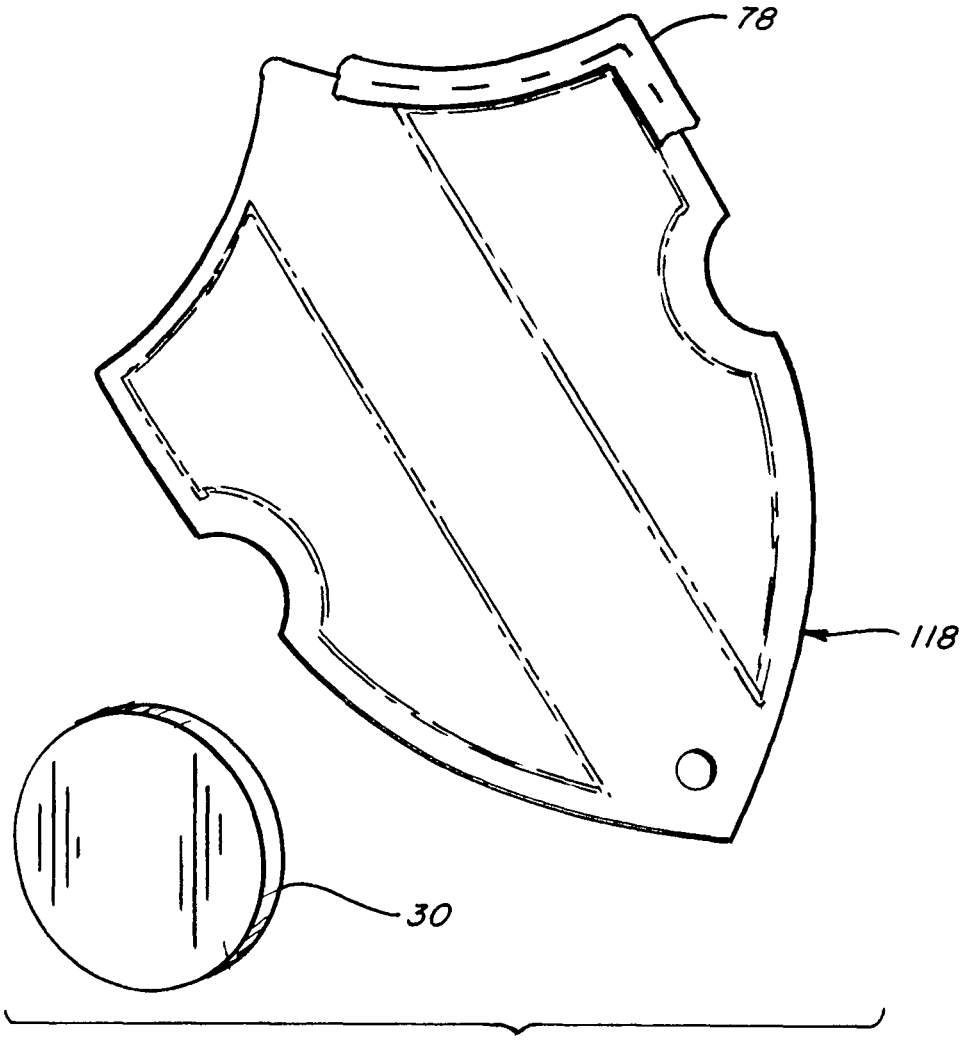
FIG. 28 is a perspective view another stay of the invention for adhesive attachment to a collar, shown with a representative magnet for magnetic attachment of the stay and collar to a shirt front.
Figure 29:
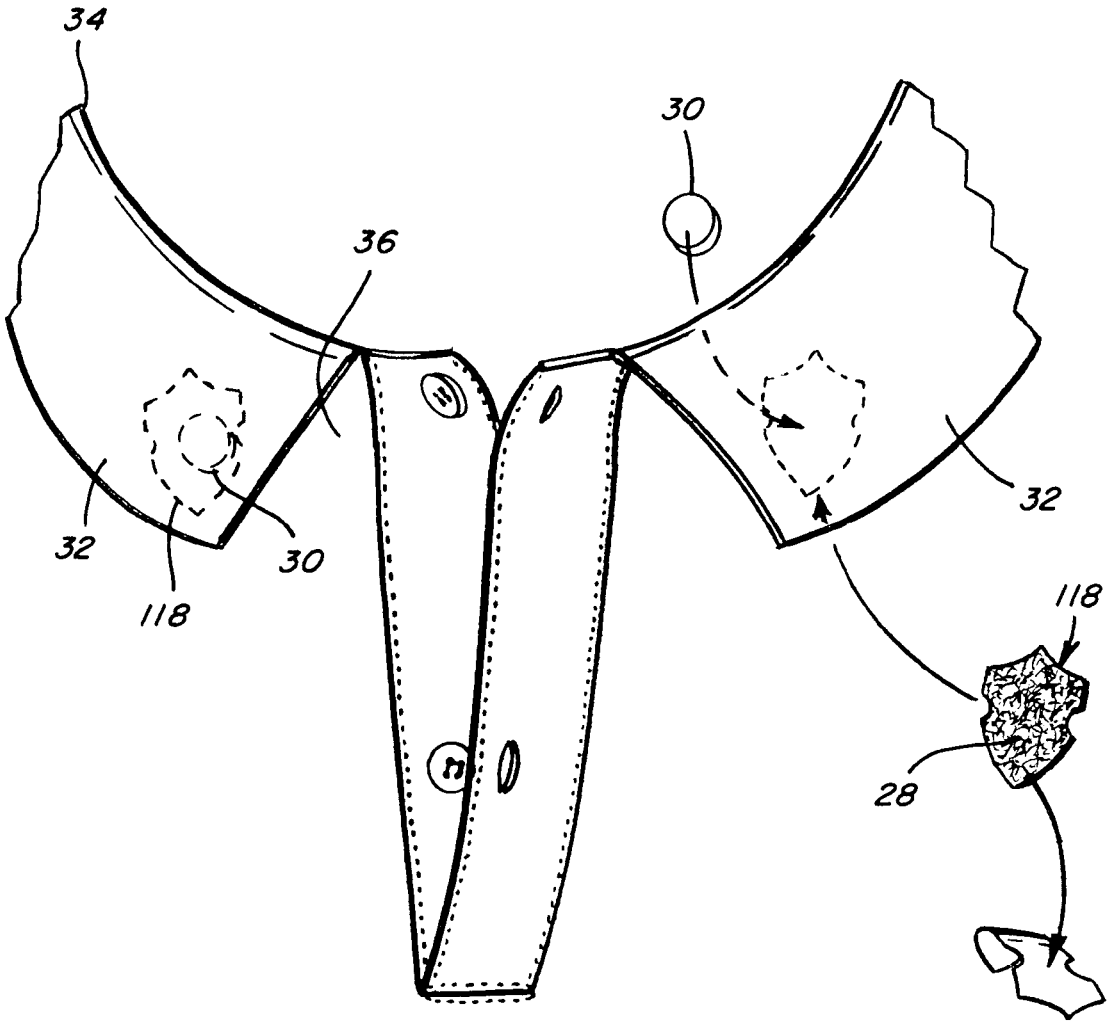
FIG. 29 is a front view of a shirt with one stay of FIG. 28 adhesively attached to a collar of the shirt and magnetically attaching the collar to a shirt front, and illustrating steps of adhesive attachment of another stay to the other collar of the shirt.
Figure 30:
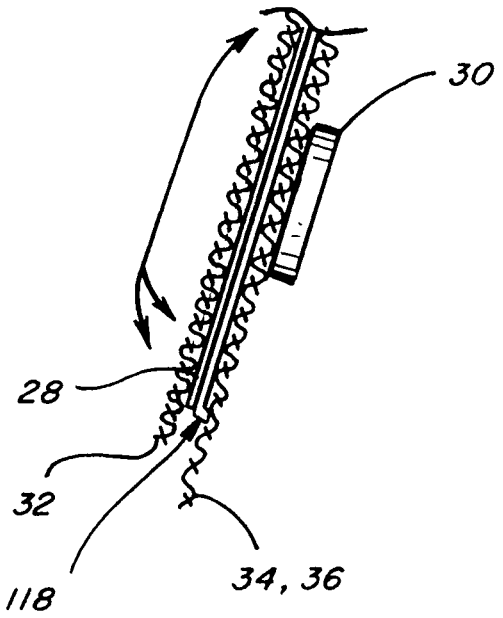
FIG. 30 is a side view of the stay of FIG. 29, adhesively attached to a collar and magnetically attaching the collar to a shirt front.

Here, it should be understood that any of collar stays 56, 60, 64 or 68 can include an adhesive on an outside surface thereof, such as illustrated by layer of adhesive 28 in FIG. 2, and also FIGS. 28, 29 and 30, or can be smooth so as to be readily insertable into a collar stay pocket, as illustrated in FIG. 4. Additionally, collar stays 64 and 68 can be inserted into a collar stay pocket with the portion thereof including surface 46 located externally thereof, and surface 46 can be resiliently biased toward the body of the stay, similarly to a hairpin, for clipping about the pocket for better retention of the stay in the pocket.

FIG. 13 illustrates still another alternative magnet 72 that can be used with the present invention, magnet 72 having a side pocket 74 adapted for cooperatively receiving a detent, such as any of detents 44, 58, 62, 66 and 70, for interlocking therewith for preventing relative longitudinal movement between magnet 72 and the respective collar stay, as well as side to side and twisting movements.

Figure 14:
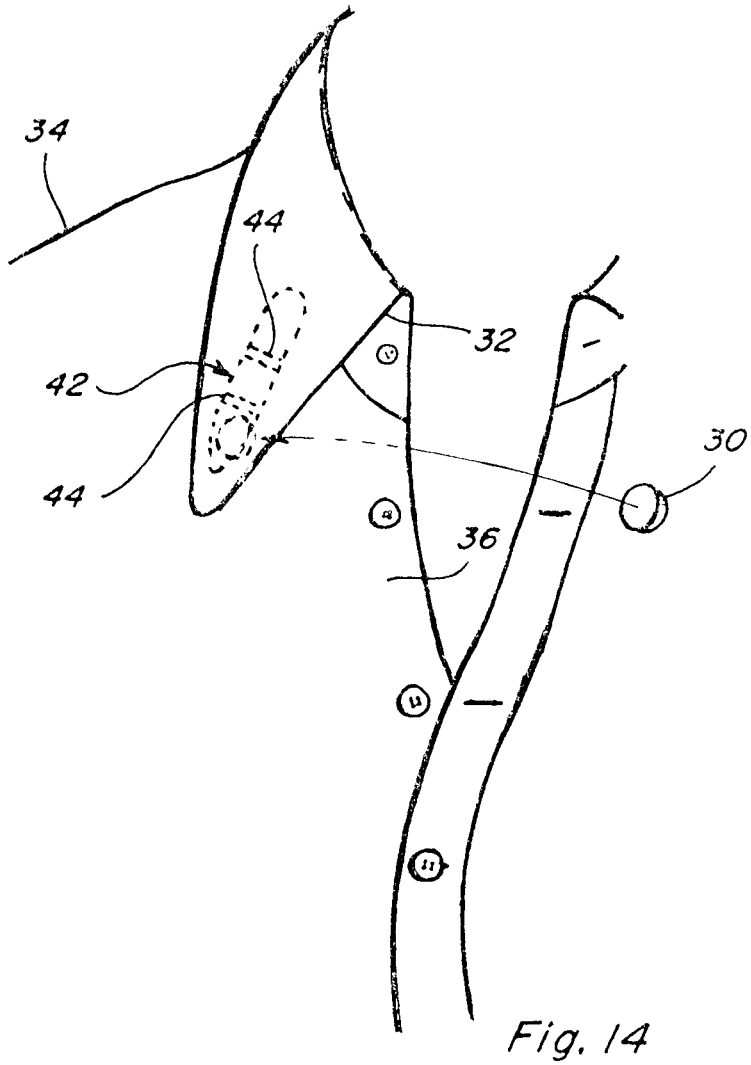
FIG. 14 is a front view of a shirt having a collar stay of the invention installed on a collar of the shirt, and illustrating use of a magnet in connection with various locations along the collar stay.

Referring also to FIG. 14, a collar stay 42 is shown in position retained on the inside surface of a collar 32, for instance, within a collar stay pocket A (FIG. 4) or adhered thereto (FIG. 5), and a magnet 30 selectively detachable thereto through a front 36 of a shirt 34, at several locations along the length of stay 42, as defined by detents 44. This illustrates the versatility of the present invention for effecting attachment of a collar 32 to a shirt front 36 in several different ways, for achieving different appearances or looks.

Figure 15:
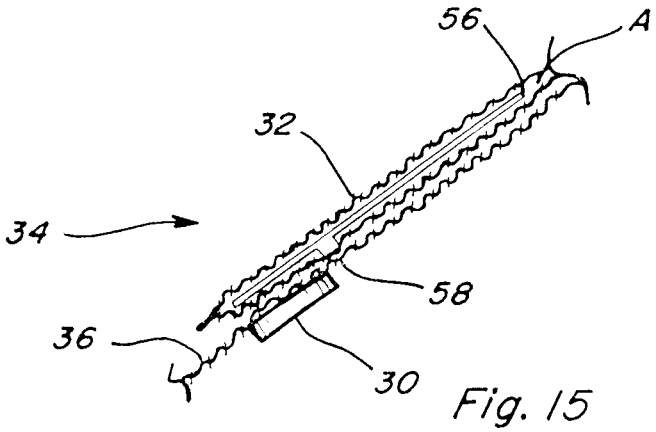
FIG. 15 is a sectional view through a shirt front and collar having a collar stay of the invention located in a pocket of the collar, and illustrating a magnet in connection therewith.

Referring also to FIG. 15, a collar 32 of a shirt 34 is shown held in place against a front 36 of the shirt by a collar stay 56 and a magnet 30 of the invention. Here, detent 58 of stay 56 is illustrated to retain and hold magnet 30 adjacent to the end of stay 56.

As discussed under the Background Art heading, it has been observed that some collar stays made of metal such as stainless steels, can cause undesired wear or damage to shirts. This has been found to be a result of the sharpness of edges of corners of the collar stays, relative hardness of the stays compared to the shirt fabric or material that they contact, and relative motion between the stay and shirt fabric, that can result from a wearer's routine body movements. Such damage and wear can be increased by activities such as dancing and the like. Also, fine fabrics, such as silks, comprise very fine filaments that can be more easily cut, sawed or abraded by the harder material and edges of the stays. As a result, it is desired to have some manner for mitigating such damage and wear.

Referring also to FIGS. 16, 17, 17A, and 17B, collar stay 20 of the above discussed material attractable by a magnet, e.g., a 400 series stainless steel, is shown incorporated into a protective collar stay 76, including a cover 78 disposed about a peripheral edge portion 80 extending about surface 46 of stay 20. Stay 76 is configured to protect the adjacent material or fabric of the shirt against wear and other damage from contact with the edge of stay 20, such as from cutting, sawing and abrading. For this purpose, cover 78 preferably comprises a suitable polymer or polymeric material, which can include, but is not limited to, a plastics material or a rubber material. Exemplary plastics for cover 78 can include synthetic or semi-synthetic organic solids, such as a polyvinylchloride, polyamide, polystyrene, polycarbonate, polypropylene, polytetrafluoroethylene, polyethylene, acrylic, cellulose acetate, and suitable mixtures thereof. Exemplary rubbery materials for cover 78 can include natural rubber, synthetic rubber, and mixtures thereof, such as, but not limited to, latexes and polyurethanes. Other natural polymers such as cellulose based plastics and the like can also be used.

Figure 16:
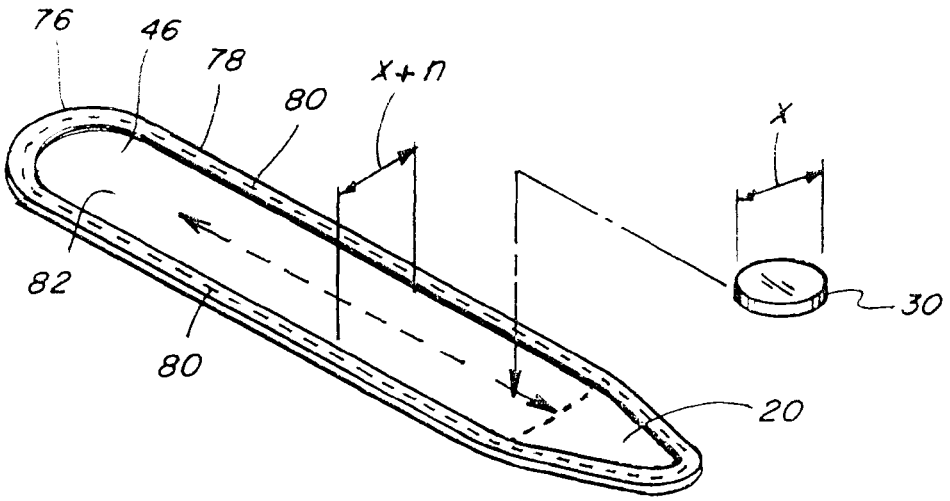
FIG. 16 is a perspective view of a protective collar stay of the invention, illustrating a manner of attachment of a magnet thereto.
Figure 17:
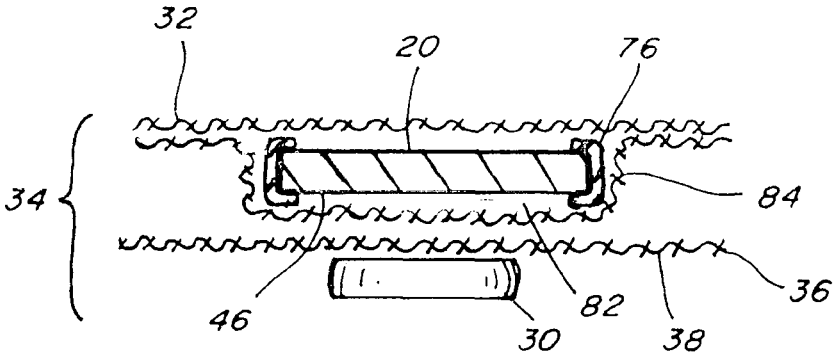
FIG. 17 is a sectional view of the collar stay of FIG. 16, located in a collar stay pocket of a shirt collar, and showing the magnet in position for magnetically attaching to the stay, for holding the collar to the front of the shirt.
Figure 17A:
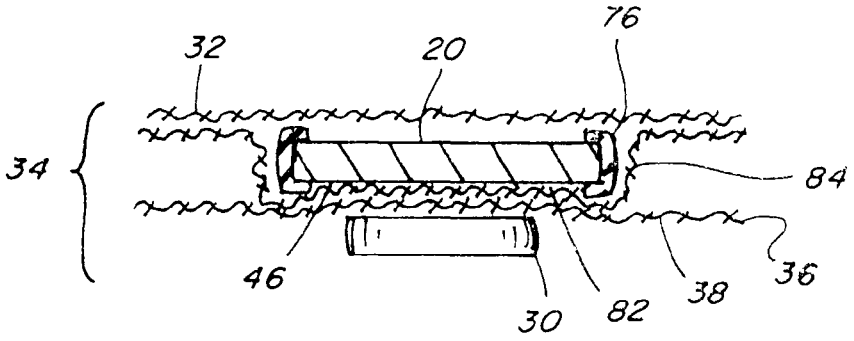
FIG. 17A is another sectional view of the collar stay and magnet of FIG. 17, holding the collar to the shirt front.
Figure 17B:
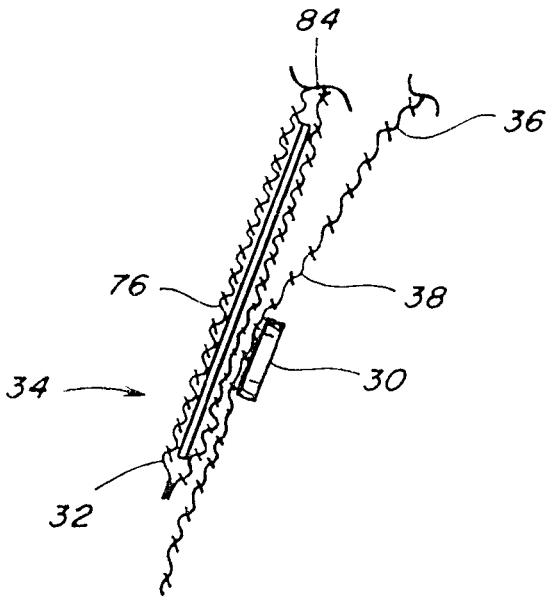
FIG. 17B is still another sectional view of the collar stay and magnet, holding the collar to the shirt front.

In this configuration, cover 78 will preferably bound a portion of inside surface 46 of stay 20, to provide the desired protection from damage and wear by peripheral edge portion 80 of the stay, while providing an aperture 82 exposing a portion of surface 46, sufficient for magnetic attachment of a magnet 30 thereto, preferably in surface to surface relation thereto, as illustrated in FIGS. 17A and 17B. In, this relationship, at least front 36 of shirt 34, and also a layer of fabric of a collar stay pocket 84 of a collar 32, if used, will be disposed and pressed between magnet 30 and surface 46 for retaining collar 32 in the desired position and orientation. To accommodate this capability without reducing the magnetic attachment or wrinkling of the fabric, aperture 82 will preferably have a dimension or extent X+n, which is marginally larger than the extent X of a magnet 30 to which the surface 46 is attached, as illustrated in FIG. 16. Thus, the value n will desirably be sufficient to allow the passage of the two fabric layers between the edge of magnet 30 and cover 78, adjacent opposite edges of magnet 30.

Figure 18:
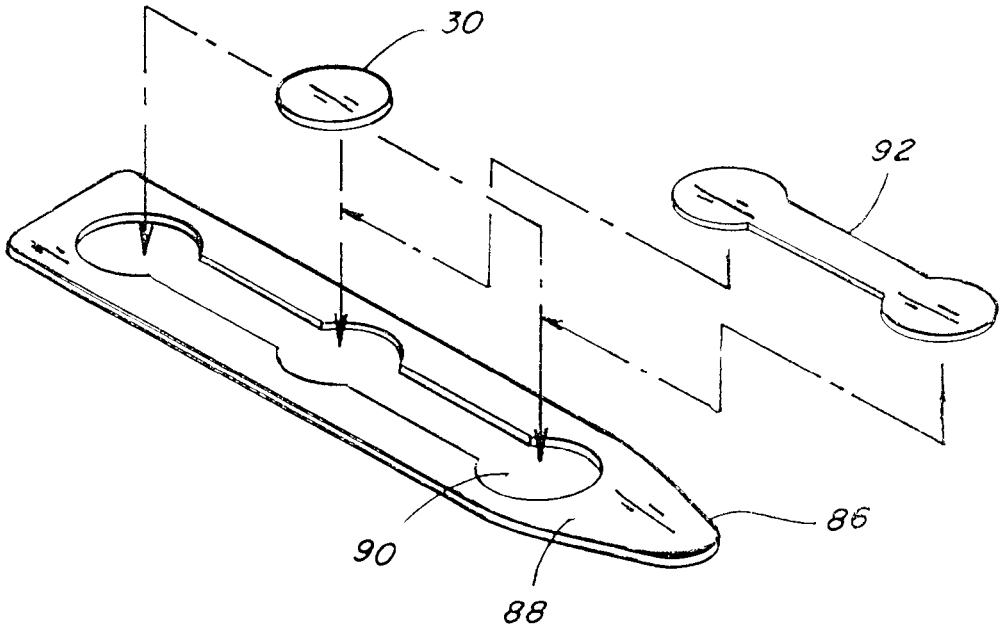
FIG. 18 is a perspective view of another protective collar stay of the invention, and alternative magnets for magnetic attachment thereto.

Referring also to FIG. 18, another protective magnetic collar stay 86 of the invention, includes a cover 88 disposed about a stay 20 of a material attractable to a magnet. Cover 88 can be formed of any of the materials listed above in reference to cover 78 and is formed to bound and define an aperture or apertures 90 for attachment of a magnet or magnets to stay 20, such as, but not limited to, a disk shaped magnet or magnets 30, or a magnet having a different shape, such as, but not limited to, a bow tie or dog bone shaped magnet 92 as illustrated. As evident, an advantage of stay 86 is the ability of magnet 30 or magnet 92 to be attached at any of several locations along underlying stay 20, to provide options and flexibility in the location and manner of attachment of a collar to a shirt front.

Figure 19:
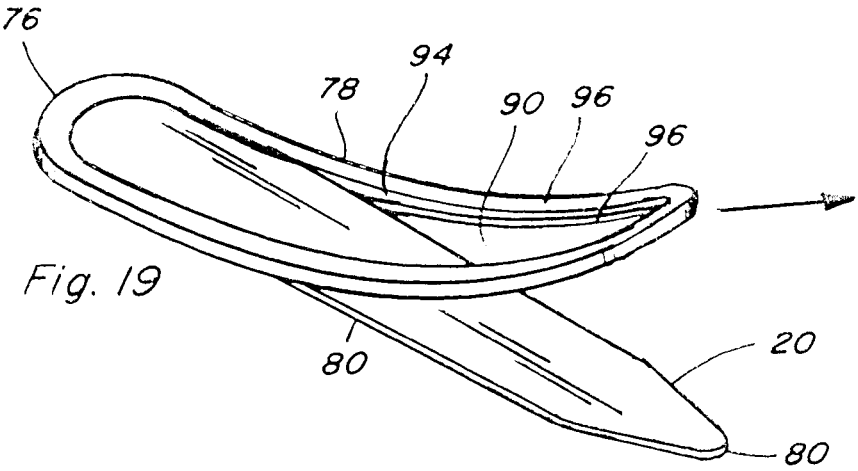
FIG. 19 is a perspective view of still another protective collar stay of the invention, showing a manner of attachment of a removable cover thereto.
Figure 20:
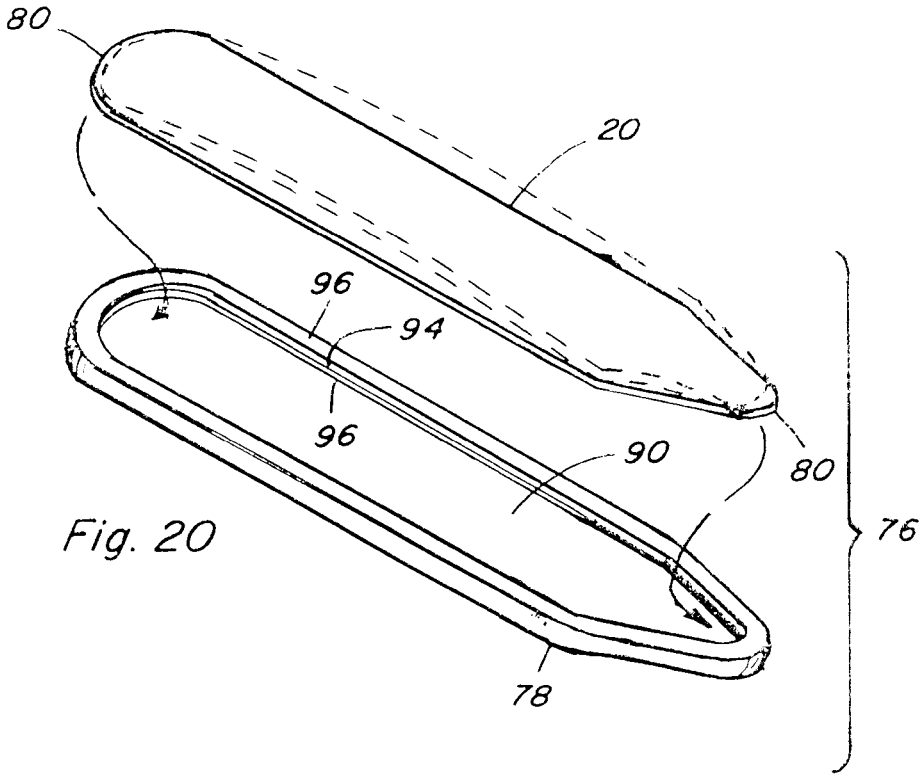
FIG. 20 is a perspective view of still another protective collar stay of the invention, showing another manner of attachment of a cover thereto.
Figure 21:
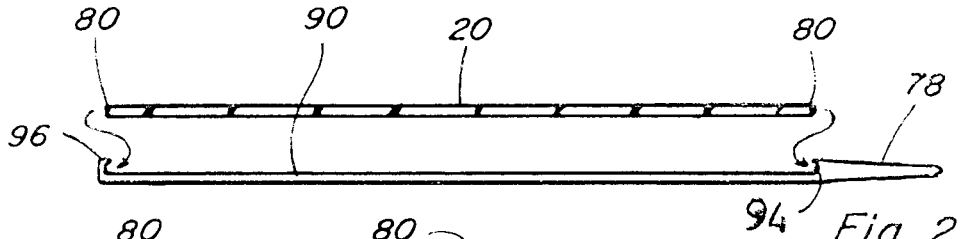
FIG. 21 is a sectional view of another protective collar stay of the invention.

Referring also to FIGS. 19, 20, 21 and 22, several representative manners of construction or assembly of protective collar stays 76 and 86 are shown. In FIG. 19, cover 78 is illustrated as resiliently elastic and flexible, so as to be capable of being stretched over edge portions 80 of stay 20, for retention about the stay. In FIG. 20, stay 20 is illustrated being flexed for insertion through aperture 82 such that edge portions 80 are received in a groove 94 extending about an inner periphery of cover 78, groove 94 being bounded on the top and bottom by spaced apart lips 96 of cover 78. In FIG. 21, cover 78 is configured to have an aperture 82 on only one side, edge portions 80 being cooperatively receivable in groove 94 which is bounded only on its upper side by a lip 96. Cover 78 here is also depicted as being longer than stay 20, that is, having a tip that extends beyond the end of stay 20.

Figure 22:
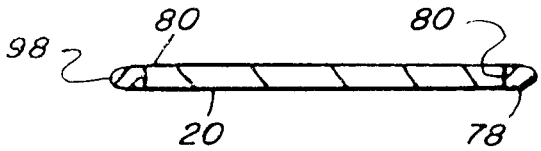
FIG. 22 is a sectional view of still another protective collar stay of the invention.
Figure 23:
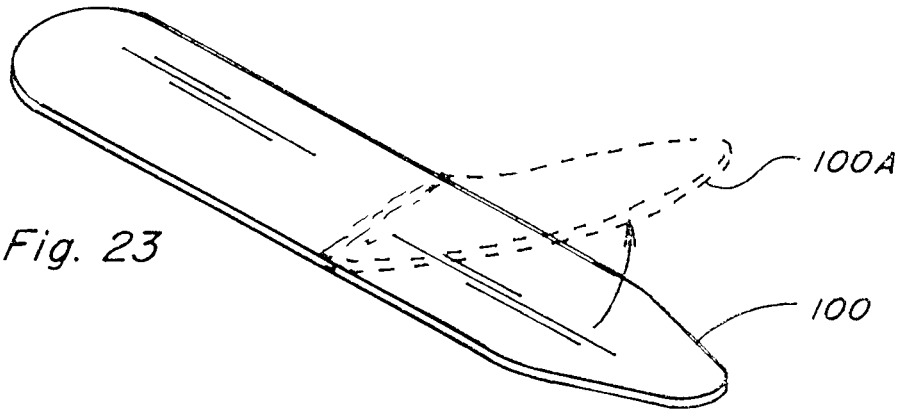
FIG. 23 is a perspective view of still another protective collar stay of the invention, shown in dotted lines in a representative alternative bent or folded shape.

Referring also to FIG. 22, a protective collar stay having a low profile cover 78 which is flush with the surfaces of stay 20, is shown. In this embodiment, cover 78 can attached to edge portions 80 of stay 20 in a suitable manner, such as by bonding or adhesives.

Figure 24:
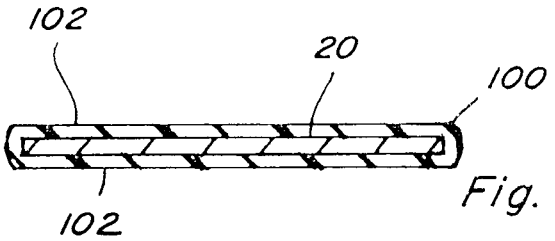
FIG. 24 is a sectional view of the collar stay of FIG. 23.
Figure 25:
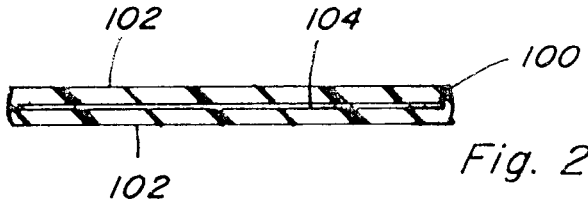
FIG. 25 is a sectional view of an alternative construction of the collar stay of FIG. 23.

Referring also to FIGS. 23, 24, 25 and 26, several embodiments of an encapsulated protective collar stay 100 are shown. Stay 100 can be optionally bendable or foldable and self-retaining in a desired shape, as denoted in dotted lines by numeral 100A. In FIG. 24, stay 20 is encapsulated by a thin protective outer layer or layers 102 of suitable plastics or rubber material, such as any of the materials discussed above, for instance, by molding or dipping. In FIG. 25, the stay comprises a foil 104 or thin layer of a ferrous or other material attractable by a magnet, encapsulated by a coating or layer 102 of any of the above plastics or rubbery materials.

Figure 26:
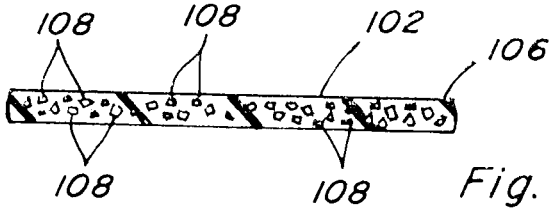
FIG. 26 is a sectional view of another alternative construction of the collar stay of FIG. 23.

Referring also to FIG. 26, a protective collar stay 106 of a composite construction, including a body or layer 102 of a plastics or rubbery material, having particles 108 of a material attractable by a magnet, dispersed therethrough, is shown. Exemplary materials attractable by a magnet that can be used include, but are not limited to, iron, electroplated iron, carbon steel and 400 series stainless steel.

Figure 27:
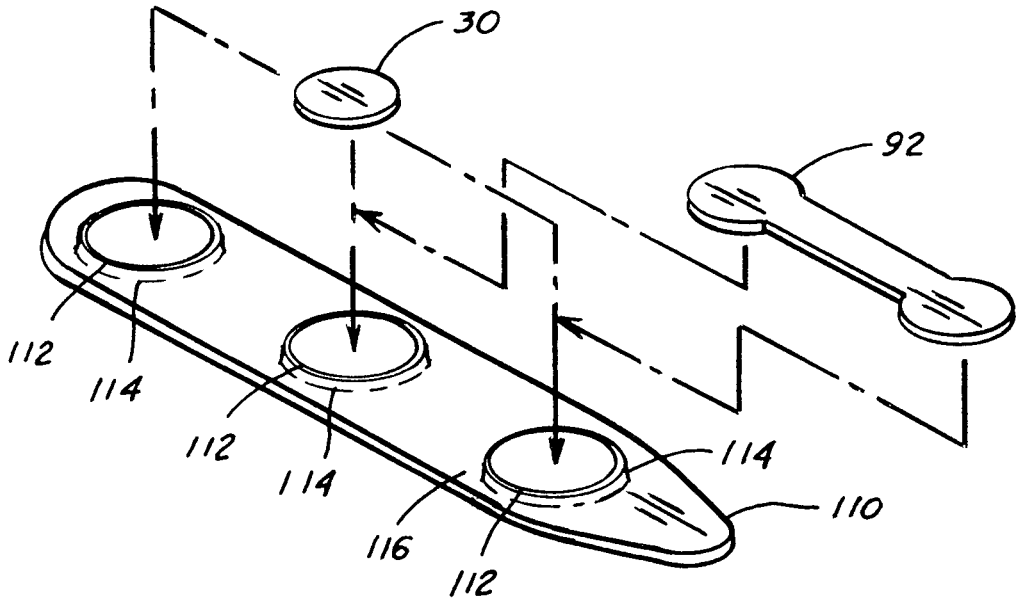
FIG. 27 is a perspective view of still another protective collar stay of the invention, and alternative magnets for magnetic attachment thereto.

Referring also to FIG. 27, still another protective collar stay 110 of the invention is shown. Stay 110 has the same overall shape of several of the above discussed stays, and comprises a protective material such as any of the polymer or rubber materials listed above for cover 78. Stay 110 additionally includes one or more raised buttons 112 of a material attractable by a magnet, such as those listed above for stay 20, and preferably bounded by a thin rim 114 of the protective material, such that a surface of the button or buttons is bounded by rim 114. Preferably, buttons 112 will project from about 0.2 to about 1 mm from a surface 116 of the stay, and rim 114 will project only slightly, if at all, past the surface of the button or buttons bounded thereby. Configuring button or buttons 112 so as to be located a small distance such as this above the surface of the stay, while still protecting the shirt fabric from damaging contact with edges of the button or buttons, is advantageous, as it protects the shirt front fabric without having to be pressed by a magnet or magnets 30, 92, etc., into recessed apertures so as to be noticeably deformed. Here again, as with stay 86, an advantage of stay 110 is the ability of magnet 30, or magnet 92, to be attached at any of several locations along the stay, to provide options and flexibility in the location and manner of attachment of a collar to a shirt front. As possible manners of construction, stay 110 can be constructed using an underlying member such as a stay 20, shaped to form buttons 112, e.g., by stamping, so as to project from the surface of the stay, and the rest of the stay up to and about the rims of the buttons, encapsulated by the protective material. Alternatively, an element containing buttons 112, or individual buttons 112, can be retained by molding the protective material thereabout, such that only the flat surfaces of the buttons are exposed.

Referring also to FIGS. 28, 29 and 30, another embodiment of an adhesive collar stay 118, for use with a magnet, such as magnet 30 disclosed above, is shown, like parts of stay 118 and the other stays discussed above being described by like numbers. Here, stay 118 has a shield shape, although it should be recognized and understood that stay 118 can have a variety of different shapes, such as, but not limited to, a disk or circular shape, as desired or required for a particular application. Stay 118 can also include features discussed above, such as, but not limited to the thin rim 114 of protective material (FIG. 27); encapsulation as with stay 100 (e.g. FIG. 24); or a low profile cover 78 (shown), to have the advantages provided by those features, as desired or required for a particular application. Stay 118 can be fabricated from any of the materials discussed above, e.g., stainless steel, composite, etc., attractable by a magnet, and can be bendable in the above described manner, as denoted by an arrow in FIG. 30. As also illustrated, it can be observed that stay 118 does not require a stay pocket, and as such can have a greater width compared to the stays previously illustrated, an advantage of which can be the ability to shape the portion of the collar to which it is attached, e.g., straight or curved (by bending the stay). Stay 118 is applied in the above described manner: peeling the backing from the adhesive strip (FIG. 29); adhering the stay to the inside or outside surface of the collar 32; positioning the collar in desired position and relation to the shirt front 36, and effecting the magnetic attachment by positioning the magnet 30 in the desired location behind the shirt front, e.g., as shown on the left side in FIG. 29 and in FIG. 30.

As should be apparent from the disclosure above, the various embodiments of collar stays and magnets of the invention can be used in combination to achieve a desired retention and positioning of a collar in relation to a shirt front, including the angular orientation of the collar in relation thereto, without the apparatus used for the same being visible or apparent to persons observing the shirt. The various collar stays can optionally be bendable to some extent by hand, to achieve a desired look, for instance, for fashion purposes. Thus, for example, a collar could be positioned and retained by the present apparatus in a widely spread manner, for a more contemporary look, or less spread, so as to be positioned closer to the neck of a shirt, for a more traditional look.

Thus, there has been shown and described a novel apparatus for keeping a shirt collar aligned and fastened, magnetically, which overcomes many of the problems set forth above. It will be apparent, however, to those familiar in the art, that many changes, variations, modifications, and other uses and applications for the subject device are possible. All such changes, variations, modifications, and other uses and applications that do not depart from the spirit and scope of the invention are deemed to be covered by the invention which is limited only by the claims which follow.

What is claimed is:

1. Apparatus for magnetically holding a shirt collar in a position and orientation on a shirt front, comprising in combination:

a collar stay configured for attachment to a surface of a shirt collar or positionable within a collar stay pocket of a collar, the collar stay comprising at least one surface bounded by a peripheral edge portion, the collar stay comprising a material attractable by a magnet, and at least the peripheral edge portion of the collar stay being covered by a cover of a plastics material or a rubbery material; and a magnet positionable against an inside surface of a shirt front opposite a collar thereof and operable for magnetic attachment to the elongate collar stay through the shirt front, for holding a collar to which the collar stay is attached, against the shirt front.

2. Apparatus of claim 1, wherein the at least one surface is at least partially covered by the cover.

3. Apparatus of claim 2, wherein the magnet has a surface configured to be magnetically attached to the at least one surface and having a predetermined extent, and the cover defines at least one aperture having a dimension sufficiently larger than the predetermined extent for cooperatively receiving the magnet and at least one layer of the shirt between the magnet and the surface.

4. Apparatus of claim 1, wherein the cover substantially covers the stay.

5. Apparatus of claim 1, wherein the magnet is disk shaped, and the cover bounds and defines at least one aperture over a surface portion of the stay, having a shape that is marginally larger than a surface of the disk shaped magnet, for magnetic attachment of the magnet to the surface portion through the aperture with at least one layer of the shirt held therebetween.

6. Apparatus of claim 1, wherein the collar stay comprises a 400 series stainless steel material.

7. Apparatus of claim 1, wherein the cover comprises an elastic material stretched over the stay.

8. Apparatus of claim 1, wherein the magnet is a neodymium magnet.

9. Apparatus of claim 1, wherein the stay is a laminate comprising at least one inner layer comprising the material attractable by a magnet, and at least one outer layer comprising the cover.

10. Apparatus of claim 9, wherein the at least one inner layer comprises a ferrous foil.

11. Apparatus of claim 9, wherein the cover comprises a composite of a fibrous material and a plastics resin.

12. Apparatus of claim 1, wherein the stay comprises a composite of the material attractable by a magnet and the plastics or rubbery material.

13. Apparatus of claim 1, wherein the stay is configured so as to bendable or foldable into a curved or angled shape and to retain the shape.

14. Apparatus magnetically holding a shirt collar in a position and orientation on a shirt front, comprising in combination:

a collar stay attached to a surface of the shirt collar or positioned within a collar stay pocket of the collar, the collar stay comprising a material attractable by a magnet and including a peripheral edge portion therearound comprising a polymer material; and a magnet positioned against an inside surface of the shirt front opposite the collar and magnetically holding the collar stay to the shirt front through the shirt front, holding the collar thereagainst and substantially limiting relative movement therebetween.

15. Apparatus of claim 14, wherein the collar stay further comprises at least one outer surface comprising the polymer material.

16. Apparatus of claim 15, wherein the peripheral edge portion of the polymer material bounds and defines at least one aperture receiving a portion of the magnet with at least one layer of the shirt disposed between the stay and the magnet.

17. Apparatus of claim 16, wherein the polymer material bounds and defines a plurality of the apertures.

18. Apparatus of claim 14, wherein the magnet is disk shaped, and the cover defines at least one aperture over a surface portion of the stay, having a shape that is marginally larger than a surface of the magnet, and which cooperatively receives the magnet to hold a portion of the shirt front between the magnet and the surface portion of the stay.

19. Apparatus of claim 14, wherein the polymer material comprises an elastic polymer and the peripheral edge portion is stretched over the stay.

20. Apparatus of claim 14, wherein the magnet is a neodymium magnet.

21. Apparatus of claim 14, wherein the stay is a laminate comprising at least one inner layer comprising the material attractable by a magnet, and at least one outer layer comprising the polymer material.

22. Apparatus of claim 21, wherein the at least one inner layer comprises a ferrous foil.

23. Apparatus of claim 21, wherein the at least one outer layer comprises a composite of a fibrous material and a plastics resin.

24. Apparatus of claim 14, wherein the stay comprises a composite of the material attractable by a magnet and the polymer.

25. Apparatus of claim 14, wherein the stay is bendable or foldable into a curved or angled shape.

26. Apparatus of claim 14, wherein the material attractable by a magnet of the stay comprises at least one raised portion bounded by a rim of the polymer material.

27. Apparatus for magnetically holding a shirt collar in a position and orientation on a shirt front, comprising in combination:

a collar stay configured for attachment to a shirt collar or positionable within a collar stay pocket of a collar, the collar stay comprising at least one surface bounded by a peripheral edge portion, the collar stay comprising a material attractable by a magnet, and at least the peripheral edge portion of the collar stay being covered by a cover of a polymeric material; and a magnet positionable against an inside surface of a shirt front opposite a collar thereof and operable for magnetic attachment to the elongate collar stay through the shirt front, for holding a collar to which the collar stay is attached, against the shirt front.

28. Apparatus of claim 27, wherein the at least one surface is at least partially covered by the cover.

29. Apparatus of claim 28, wherein the magnet has a surface configured to be magnetically attached to the at least one surface and having a predetermined extent, and the cover defines at least one aperture having a dimension sufficiently larger than the predetermined extent for cooperatively receiving the magnet and at least one layer of the shirt between the magnet and the surface.

30. Apparatus of claim 27, wherein the cover substantially covers the stay.

31. Apparatus of claim 27, wherein the magnet is disk shaped, and the cover bounds and defines at least one aperture exposing a surface portion of the stay having a shape that is marginally larger than a surface of the disk shaped magnet, for magnetic attachment of the magnet to the surface portion through the aperture with at least one layer of the shirt held therebetween.

32. Apparatus of claim 27, wherein the collar stay comprises a 400 series stainless steel material.

33. Apparatus of claim 27, wherein the cover comprises an elastic material stretched over the stay.

34. Apparatus of claim 27, wherein the magnet is a neodymium magnet.

35. Apparatus of claim 27, wherein the stay is a laminate comprising at least one inner layer comprising the material attractable by a magnet, and at least one outer layer comprising the cover.

36. Apparatus of claim 35, wherein the at least one inner layer comprises a ferrous foil.

37. Apparatus of claim 35, wherein the cover comprises a composite of a fibrous material and a plastics resin.

38. Apparatus of claim 27, wherein the stay comprises a composite of the material attractable by a magnet and the plastics or rubbery material.

39. Apparatus of claim 27, wherein the stay is bendable or foldable into a curved or angled shape.

40. Apparatus for magnetically holding a shirt collar in a position and orientation on a shirt front, comprising in combination:

a collar stay adapted for attachment to a surface of a shirt collar, the collar stay comprising a material attractable by a magnet; and a magnet positionable against an inside surface of a shirt front opposite a collar thereof and operable for magnetic attachment to the collar stay through the shirt front, for holding a collar to which the collar stay is attached, against the shirt front, wherein the collar stay has an outer surface including an adhesive thereon for adhesive attachment to a surface of a shirt collar.

41. Apparatus of claim 40, wherein the stay has a shield shape.

42. Apparatus of claim 40, wherein the adhesive comprises a layer of an adhesive tape.

43. Apparatus of claim 40, wherein the adhesive comprises a sprayed on adhesive layer.

44. Apparatus of claim 40, wherein the stay comprises a 400 series stainless steel.

45. Apparatus of claim 40, wherein the stay comprises at least one peripheral edge of a protective polymer material.

* * * * *